US005606216A

United States Patent [19]

Uchida et al.

[11] Patent Number: 5,606,216

[45] Date of Patent: Feb. 25, 1997

[54] COLOR CATHODE-RAY TUBE WITH REDUCED MOIRE

[75] Inventors: Go Uchida; Shoji Shirai; Takashi Kinami, all of Mobara; Noboru Mizukami, Isumi-gun, all of Japan

[73] Assignees: Hitachi, Ltd., Tokyo; Hitachi Device Engineering Co., Ltd., Chiba-ken, both of Japan

[21] Appl. No.: 397,879

[22] Filed: Mar. 2, 1995

[30] Foreign Application Priority Data

Mar. 9, 1994 [JP] Japan ..... 6-038371

[51] Int. Cl.[6] ..... H01J 29/50; H01J 31/00

[52] U.S. Cl. ..... 313/412; 313/414; 313/409; 313/389; 313/390

[58] Field of Search ..... 313/412, 414, 313/409, 389, 390, 428; 315/14, 15

[56] References Cited

U.S. PATENT DOCUMENTS 5,170,101 12/1992 Gorski ..... 313/412

5,430,349 7/1995 New ..... 313/412

FOREIGN PATENT DOCUMENTS 53-18866 6/1978 Japan .

OTHER PUBLICATIONS

"In–Line Type High–Resolution Color Display Tube", National Technical Report, vol. 28, No. 1, Feb. 1982.

*Primary Examiner*—Sandra L. O'Shea
*Assistant Examiner*—John Ning
*Attorney, Agent, or Firm*—Antonelli, Terry, Stout & Kraus

[57] ABSTRACT

A color cathode-ray tube has an in-line type electron gun. Third, fourth, and fifth electrodes form a sub-main lens, and a sixth electrode forms a main lens with the fifth electrode for focusing the three electron beams onto the phosphor screen. The second and fourth electrodes are electrically connected together and the third and fifth electrodes are electrically connected together. A ratio A of an axial length of the fourth G4 electrode to a diameter of the opening of the fourth electrode and a ratio B of an axial length of the fifth G5 electrode to the diameter of the opening of fourth electrode satisfy the following equations: $54A-5B+4 \leqq 0$, $55A-5B+7 \geqq 0$, $A-0.18 \geqq 0$, and $95A+10B-73 \geqq 0$.

6 Claims, 5 Drawing Sheets

COLOR CATHODE-RAY TUBE WITH REDUCED MOIRE

BACKGROUND OF THE INVENTION

The present invention relates to a color cathode-ray tube having an in-line type electron gun structured so as to emit three electron beams in a horizontal plane toward a phosphor screen.

Generally, recent color cathode-ray tubes employ an in-line type electron gun. The in-line type electron gun is structured to emit a plurality of, usually three, electron beams in a common plane (horizontal plane). The plurality of electron beams are focused on a phosphor screen of the color cathode-ray tube to reproduce a color image.

FIG. 3 depicts an axially cross-sectioned view illustrating a prior color cathode-ray tube having an in-line type electron gun. The color cathode-ray tube is made up of a panel 10, a funnel 20, a neck 30, a phosphor screen 40 formed on the inner surface of the panel 10, a shadow mask 50 that is a color selection electrode, and a deflection yoke 60 mounted outside the funnel 20. The in-line type electron gun 70 (hereinafter referred to as the electron gun) is contained in the neck 30. In the figure, R, G, and B denote a red, green, and blue electron beams, respectively.

The three electron beams R, G, and B emitted from the in-line type electron gun 70 are deflected by the deflection yoke 60 horizontally and vertically. The electron beams then are color-selected by the shadow mask 50 and impinge on and excite the phosphor screen 40 of the intended color corresponding to each beam to reproduce a two-dimensional image.

FIG. 4 depicts a vertical cross-sectioned view illustrating a prior in-line type electron gun. The electron gun is made up of a cathode 01, a first electrode 02 (hereinafter referred to as the G1 electrode), a second electrode 03 (G2 electrode), a third electrode 04 (G3 electrode), a fourth electrode 05 (G4 electrode), a fifth electrode 06 (G5 electrode), a sixth electrode 07 (G6 electrode), an aperture 08 of the G1 electrode, an aperture 09 of the G2 electrode, an aperture 010 of the G3 electrode on the G2 electrode side, an opening 011 of the G3 electrode on the G4 electrode side, an opening 012 of the G4 electrode, an opening 013 of the G5 electrode on the G4 electrode side, an opening 014 of the G5 electrode on the G6 electrode side, and an opening 015 of the G6 electrode.

A diameter of the aperture 08 of the G1 electrode 02 is 0.4 to 0.6 mm. A diameter of the aperture 09 of the G2 electrode 03 also is 0.4 to 0.6 mm. The opening 011 of the G3 electrode 04 on the G4 electrode side is around 4.0 mm in diameter. The opening 012 of the G4 electrode 05 also is around 4.0 mm in diameter. The opening 013 of the G5 electrode 06 on the G4 electrode 05 side also is around 4.0 mm in diameter. An axial length of the G4 electrode 05 is 1.0 mm. An axial length of the G5 electrode 06 is 17.3 mm.

The in-line type electron gun structured as described above operates as follows.

Thermoelectrons emitted by the cathode 01 heated by heaters are attracted toward the G1 electrode 02 by a positive voltage of 400 to 1,000 V applied to the G2 electrode 03 to form the three electron beams arranged in a plane perpendicular to the sheet of drawing.

Each of the three electron beams passes through the aperture 08 of the G1 electrode 02 and passes the aperture 09 of the G2 electrode 03. The beam then is preliminarily focused a little by a sub-main lens formed of the G3 electrode 04 having a low voltage of around 5 to 10 kV applied thereto, the G4 electrode 05 having the same voltage applied thereto as a voltage impressed on the G2 electrode 03, and the G5 electrode 06 having the same voltage applied thereto as the voltage of the G3 electrode 04. The sub-main lens is formed of a lens between the G3 electrode 04 and the G4 electrode 05 and a lens between the G4 electrode 05 and the G5 electrode 06. The beam, in turn, is accelerated by a positive voltage applied to the G5 electrode 06, and enters a main lens formed between the G5 electrode 06 and the G6 electrode 07.

A potential difference between the G5 electrode 06 and the G6 electrode 07 with a high voltage of around 20 to 35 kV applied thereto constituting the main lens forms an electrostatic field between the G5 electrode 06 and the G6 electrode 07. Trajectories of the three electron beams fed into the main lens are bent by the electrostatic field.

As a result, each of the three electron beams is focused on the phosphor screen to form a beam spot.

To prevent defocusing of the beam spot at the periphery of the screen, the Japanese Patent Publication No. 53-18866 discloses a color cathode-ray tube having an in-line type electron gun having a rectangular recess elongated horizontally and superposed on the aperture 09 of the G2 electrode 03, on the G3 electrode 04 side.

FIG. 5 depicts a plan view illustrating the G2 electrode having the rectangular recesses elongated horizontally and superposed on the aperture of the G2 electrode 03 on the G3 electrode side. The horizontally elongated rectangular recesses *9a*, *9b*, and *9c* enclose the three respective apertures $9_1$, $9_2$, and $9_3$ aligned in line in the G2 electrode 03, on the G3 electrode side.

An appropriate depth in electrode-thickness direction of the rectangular recesses *9a*, *9b*, and *9c* provides electron beams with an appropriate astigmatism to cancel aberrations due to deflection.

SUMMARY OF THE INVENTION

The prior color cathode-ray tubes having the in-line type electron gun structured so far as described involves a problem of generating moire.

The moire is a spurious pattern in a reproduced picture, resulting from interference beats between a periodic structure of phosphor dots and scanning lines or periodic video signals, and deteriorating a resolution, if the beam spot diameter becomes smaller than a certain value. The one with scanning lines is called a raster moire or horizontal moire, the other with video signals is called a video moire or vertical moire.

The above-described prior color cathode-ray tube having the in-line type electron gun having horizontally elongated rectangular recesses superposed on the aperture 09 of the G2 electrode 03, on the G3 electrode 04 side, adversely produces more pronounced vertical moires than horizontal ones due to vertical elongation of the beam spots caused by the recesses.

The reason is described below. The color cathode-ray tube used for a monitor for a computer or the like has to have high resolutions at both a center and a periphery of the screen. For a combination of a screen of 36 cm effective diagonal size and 1,000 or more horizontal dots, and a shadow mask of a 0.31 mm or less mask pitch, the beam spot diameter at the center has to be smaller than 0.7 mm and a ratio in spot diameters of the center to the periphery of the screen has to be 1.0 to 1.3, as described in the "In-Line Type High-Resolution Color-Display Tube," National Technical Report, Vol. 28, No. 1, February 1982.

In the case of the prior in-line type electron gun without horizontally elongated rectangular recesses superposed on the aperture of the G2 electrode, on the G3 electrode side as disclosed in the Japanese Patent Publication No. 53-18866, the spot diameter at the periphery of the screen is strongly affected by aberration due to deflection, and increases to a great extent. It is not possible to make the ratio in spot diameter of the center to the periphery of the screen within the above-mentioned range of 1.0 to 1.3.

For the reason, the prior in-line type electron gun disclosed in the Japanese Patent Publication No. 53-18866 is structure to have the horizontally elongated rectangular recesses superposed on the aperture of the G2 electrode, on the G3 electrode side. Appropriate depth of the recesses is made to provide electron beams with appropriate astigmatism to cancel aberration due to deflection, to make the ratio in spot diameter of the periphery to the center of the screen within the range of 1.0 to 1.3.

However, the spot diameter at the center of the screen is elongated in the vertical direction by astigmatism. If the spot diameter at the center is made to be smaller than 0.7 mm, the spot diameter in the horizontal direction becomes exceedingly small. This makes the horizontal spot diameters small not only at the center, but also over the entire screen, and imposes a problem that vertical moire appears over the entire screen.

In view of solving the foregoing problems of the prior arts, it is an object of the present invention to provide a color cathode-ray tube having an in-line type electron gun that has deterioration in focus characteristics reduced and can obtain a quality image with no moires over the entire screen.

Briefly, the foregoing object is accomplished in accordance with aspects of the present invention by a color cathode-ray tube having an in-line type electron gun comprising electron beam generating means comprising a cathode, a first electrode, and a second electrode for emitting three electron beams toward a phosphor screen, a sub-main lens formed of a third electrode, a fourth electrode and a fifth electrode, and a main lens formed of said fifth electrode and a sixth electrode for focusing said three electron beams onto said phosphor screen in cooperation with said sub-main lens, said second and fourth electrodes being electrically connected together and said third and fifth electrodes being electrically connected together, wherein the ratio A of an axial length of said fourth G4 electrode to a diameter of an opening of said fourth electrode and the ratio B of an axial length of said fifth G5 electrode to the diameter of said opening of said fourth electrode satisfy the following equations:

$$54A-5B+4\leqq 0,$$

$$55A-5B+7\geqq 0,$$

$$A-0.18\leqq 0,$$

and $$95A+10B-73\leqq 0,$$

DETAILED DESCRIPTION OF THE PREFERRED EMBODIMENTS

A color display tube having a screen of 36 cm effective diagonal and a shadow mask of 0.31 to 0.26 mm mask pitch will not generate moire if a beam spot diameter is greater than 0.6 mm. To prevent a vertical moire, therefore, a horizontal diameter of the spot at a center of the screen has to be greater than 0.6 mm. To retain a high resolution, an average diameter of the spot at the center of the screen has to be smaller than 0.7 mm. Taking these into account, a vertical diameter of the spot at the center of the screen has to be smaller than 0.8 mm.

The vertical diameter of the spot at the center of the screen changes with a diameter of the beam entering into a main lens. To make small the diameter of the beam spot at the center of the screen, the diameter of the beam entering into the main lens has to be made large to a certain degree.

Figure 2:
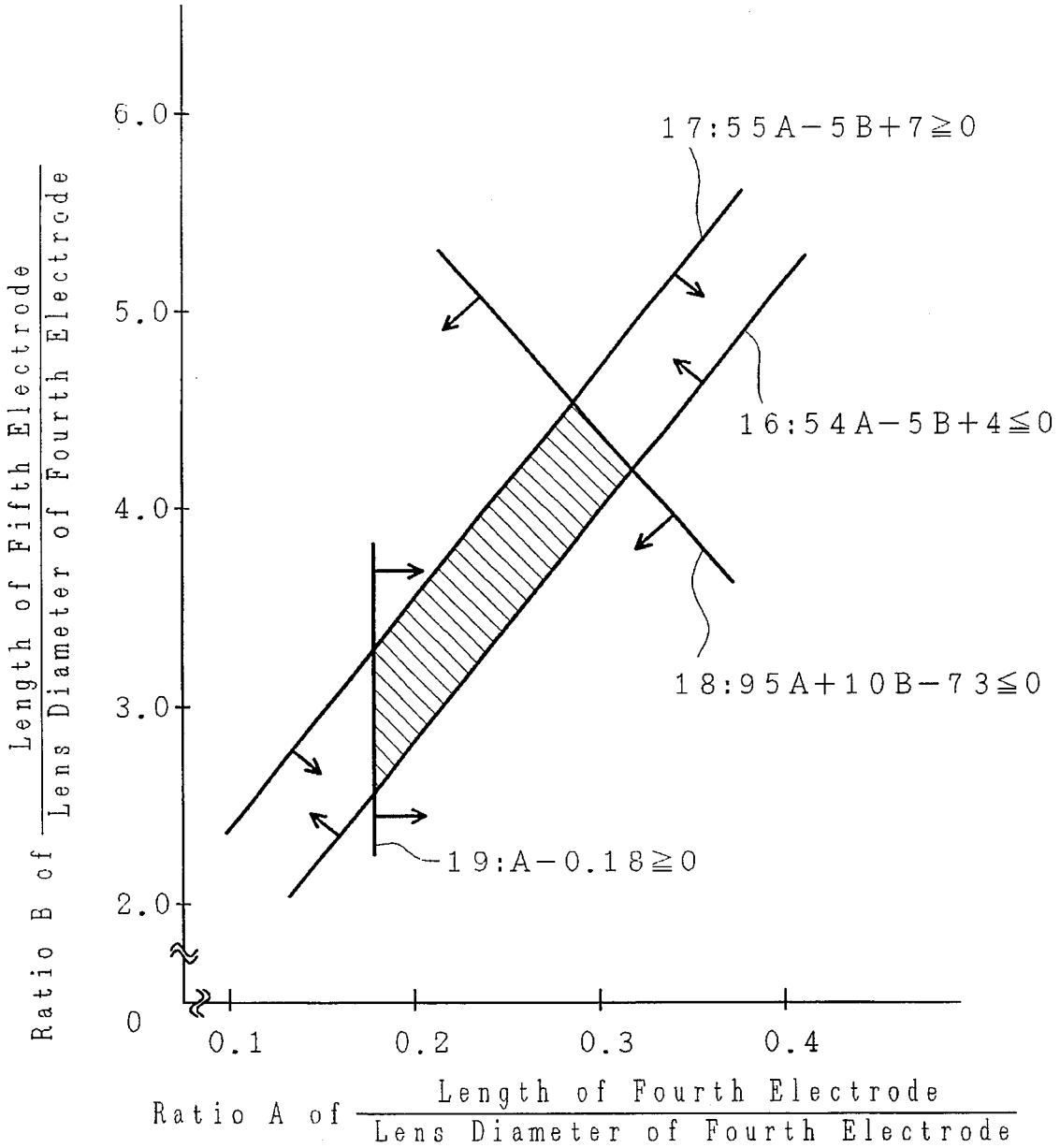
FIG. 2 illustrates a relationship between the ratio A of an axial length of a G4 electrode to a diameter of an opening of the G4 electrode and the ratio B of an axial length of a G5 electrode to a diameter of the opening of the G4 electrode.
Figure 3:
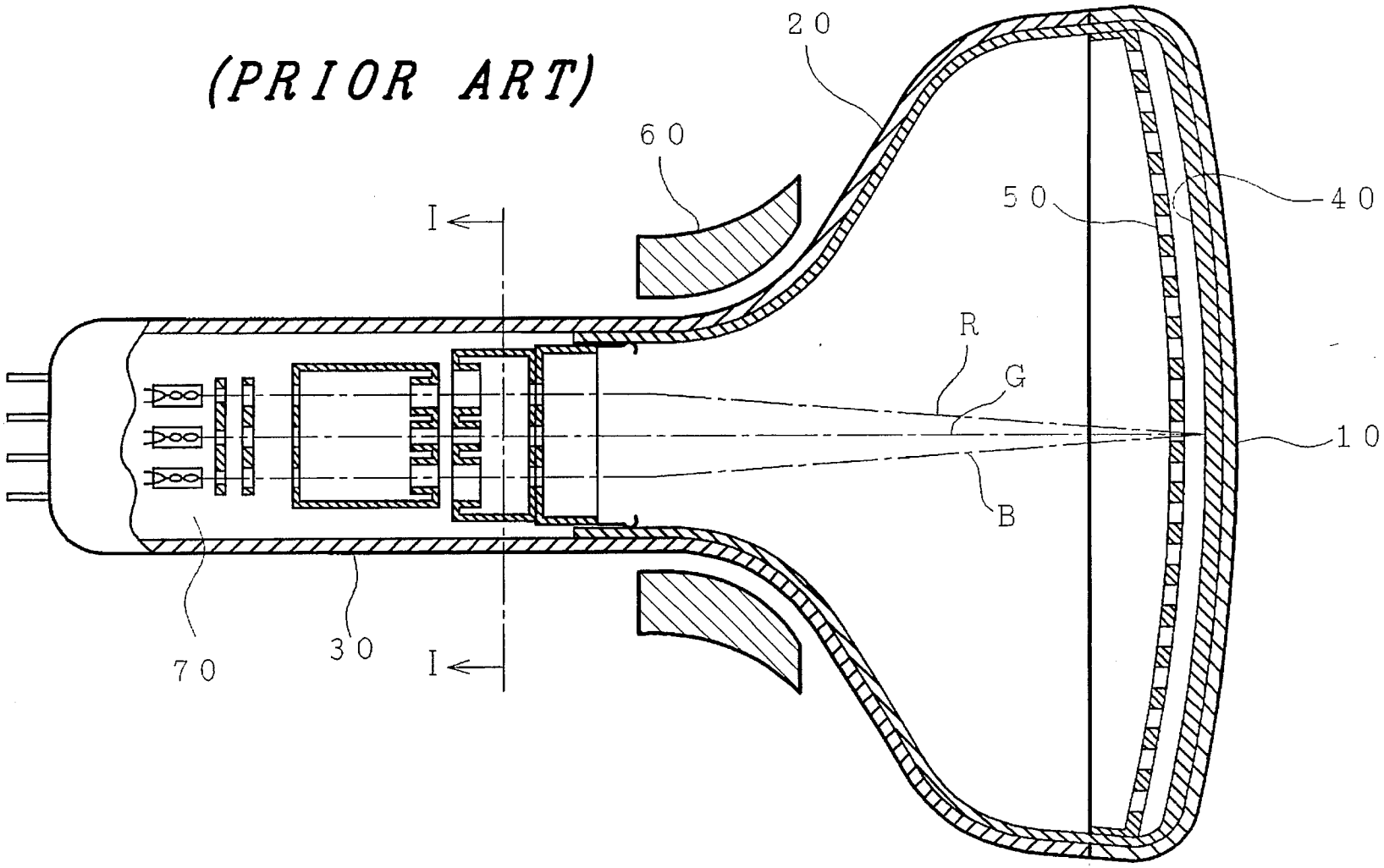
FIG. 3 (PRIOR ART)
FIG. 3 depicts an axially cross-sectioned view illustrating a prior color cathode-ray tube having an in-line type electron gun.
Figure 4:
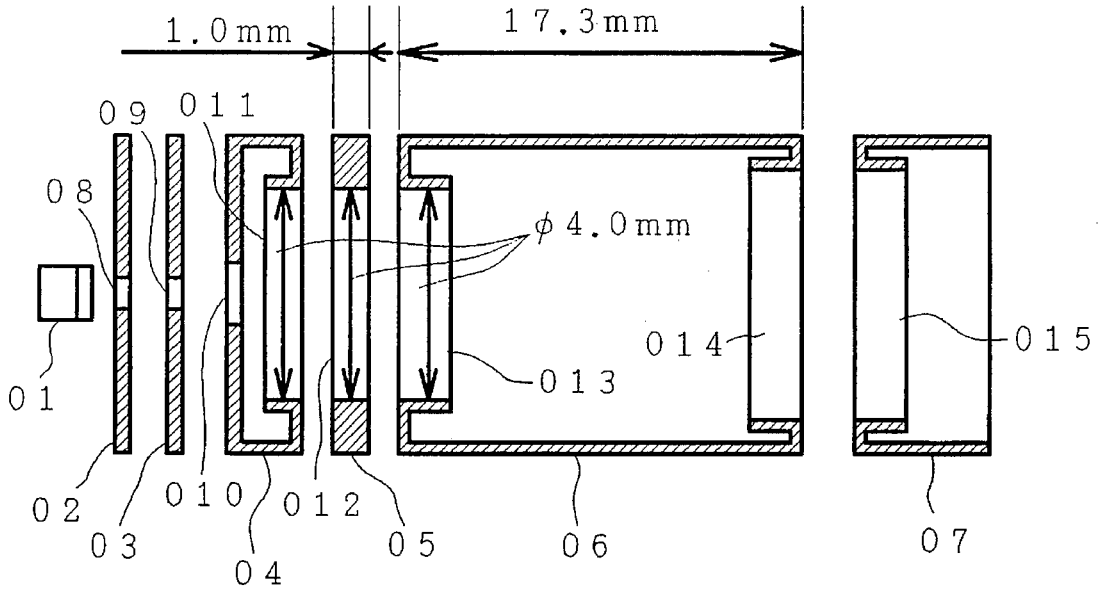
FIG. 4 depicts a vertical cross-sectioned view illustrating a prior in-line type electron gun.

FIG. 2 illustrates a relationship between the ratio A of an axial length of a G4 electrode to a diameter of an opening of the G4 electrode and the ratio B of an axial length of a G5 electrode to the diameter of the opening of the G4 electrode.

The diameter of the beam entering into the main lens increases as the ratio A of the axial length of the G4 electrode to the diameter of the opening of the G4 electrode increases, and it decreases as the ratio B of the axial length of the G5 electrode to the diameter of the opening of the G5 electrode decreases.

The relationship between the ratio A of the axial length of the G4 electrode to the diameter of the opening of the G4 electrode and the ratio B of the axial length of the G5 electrode to the diameter of the opening of the G4 electrode was determined by experiments on electron guns to obtain the vertical diameter of the spot smaller than 0.8 mm at the center of the screen. The relationship between A and B is indicated by the inequality below and by the straight line 16 in the figure.

$$54A-5B+4\leqq 0$$

A ratio in a diameter of beam spots of a periphery of the screen to the center of the screen has to be 1.0 to 1.3.

The ratio in the diameter of the beam spot of the periphery of the screen to the center of the screen changes with a diameter of the beam in the deflection magnetic field. The ratio can be made small with the diameter of the beam entering the main lens made small, contrary to the diameter of the spot at the center of the screen.

The relationship between the ratio A of the axial length of the G4 electrode to the diameter of the opening of the G4 electrode and the ratio B of the axial length of the G5 electrode to the diameter of the opening of the G4 electrode was determined by experiments on electron guns to make the ratio in the diameter of the spot of the periphery of the screen to the center of the screen less than 1.3. The following relationship was obtained as indicated by the straight line 17 in the figure.

$$55A-5B+7\geqq 0$$

The ratio of the axial length of the electrode to the diameter of the opening of the G4 electrode is further limited by a focus voltage as another factor.

The focus voltage applied on the G3 and G5 electrodes is supplied via a metal lead embedded in a stem at a bottom of a neck of the color cathode-ray tube. Voltages applied to a cathode, a heater, and a G1 and G2 electrodes are also supplied via other metal leads embedded in the stem at the bottom of the neck of the color cathode-ray tube. If the focus voltage is too high, it causes a problem of electric breakdown that discharges between metal leads.

A voltage around 20 to 35 kV is applied to the G6 electrode. The focus voltage degrades electric breakdown strength when it is higher than 30% of a voltage applied to a G6 electrode. Generally a ratio of the focus voltage applied on the G3 and G5 electrodes to the voltage applied to the G6 electrode increases with the increasing ratio A of the axial length of the G4 electrode to the diameter of the opening of the G4 electrode, and also increases with the increasing ratio B of the axial length of the G5 electrode to the diameter of the opening of the G4 electrode.

The relationship between the ratio A of the axial length of the G4 electrode to the diameter of the opening of the G4 electrode and the ratio B of the axial length of the G5 electrode to the diameter of the opening of the G4 electrode was determined by experiments on electron guns to make the ratio of the focus voltage to be applied on the G3 and G5 electrodes to the voltage applied on the G6 electrode less than 30%. As a result, the following relationship was obtained as indicated by the straight line 18 in the figure.

$$95A+10B-73\leqq 0$$

With the length of the G4 electrode decreasing, the structure of the electrode becomes weaker. With the lens diameter of the G4 electrode increasing, a remaining portion (bridge) between the openings for the lens becomes thinner. This also makes fragile the electrode structure.

The inventors found a problem that if the ratio A of the axial length of the G4 electrode to the diameter of the opening of the G4 electrode was less than 0.18, the electrode structure was so fragile that the electrode was frequently deformed during assembling the electron gun and it was difficult to manufacture the parts.

For the reason, the ratio A of the axial length of the G4 electrode to the diameter of the opening of the G4 electrode has to be higher than 0.18. The relationship is indicated by the straight line 19 in the figure.

The area in which the ratio A of the axial length of the G4 electrode to the diameter of the opening of the G4 electrode and the ratio B of the axial length of the G5 electrode to the diameter of the opening of the G4 electrode satisfy the four conditions mentioned above, is hatched in the figure.

If the ratio A of the axial length of the G4 electrode to the diameter of the opening of the G4 electrode and the ratio B of the axial length of the G5 electrode to the diameter of the opening of the G4 electrode are chosen within the hatched area in the figure, electric breakdown strength can be secured, the parts production can be facilitated, and the vertical moire can be suppressed without deterioration of the focus characteristics.

It is preferable that a voltage applied on the second and the fourth electrodes is lower than 1,000 V, and a voltage applied on the third and fifth electrodes is in the range of 20 to 33% of a voltage applied on the sixth electrode. If the voltage applied on the second and fourth electrodes exceeds 1,000 V, electric breakdown strength deteriorates between the first and the second electrodes and between leads embedded in a stem of a neck. If the voltage applied on the third and fifth electrodes is lower than 20% of the voltage applied on the sixth electrode or higher than 33% of the voltage applied on the sixth electrode, the electric breakdown strength deteriorates between the fifth and the sixth electrodes, or between the second and third electrodes and between leads embedded in the stem, respectively.

It is preferable that the diameter of the sub-main lens (the diameter of the opening of the fourth electrode) is in the range of 3.0 to 6.2 mm. If the diameter of the sub-main lens is smaller than 3 mm, the mandrel jig for assembling an electron gun becomes weak in structural strength, resulting in degradation of accuracy of an electron gun assembly, and if the diameter of the sub-main lens exceeds 6.2 mm, fabrication of the electrode becomes difficult because the outside diameter of the fourth electrode is limited by the diameter of a neck of a glass bulb and the width of a remaining portion between the adjacent openings of the electrodes becomes too small.

The invention will now be described in more detail by way of an embodiment with reference to the accompanying drawings.

Figure 1:
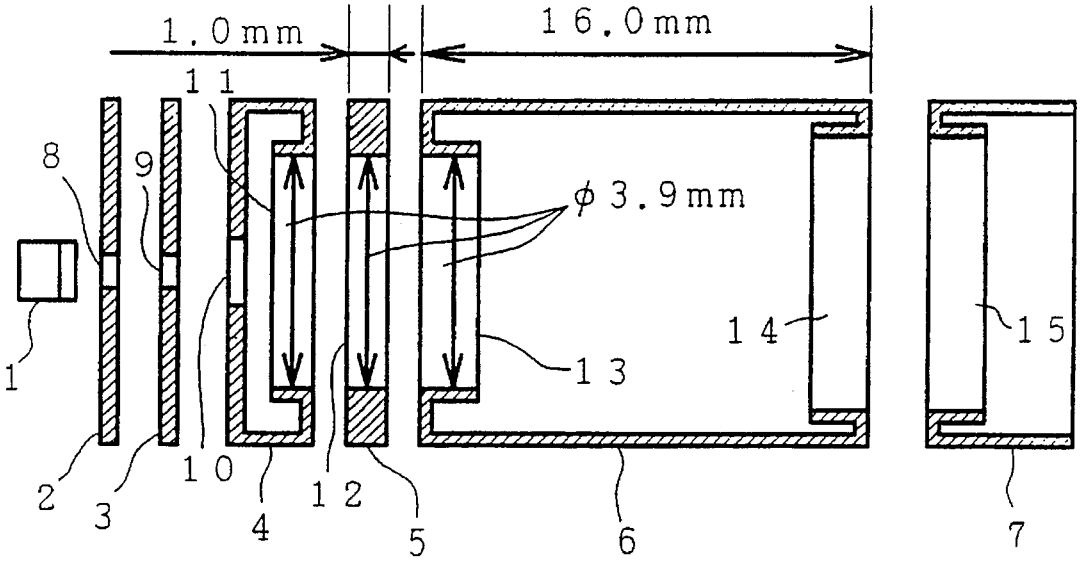
FIG. 1 depicts a vertical cross-sectional view illustrating an embodiment of an in-line type electron gun for use in the color cathode-ray tube according to the present invention.

FIG. 1 depicts a vertical cross-sectional view illustrating an example of an in-line type electron gun for use in the color cathode-ray tube according to the present invention. The electron gun comprises a cathode 1, a G1 electrode 2, a G2 electrode 3, a G3 electrode 4, a G4 electrode 5, a G5 electrode 6, a G6 electrode 7. The numeral 8 denotes an aperture of the G1 electrode 2, 9 an aperture of the G2 electrode 3, an aperture of the G3 electrode 4 on the G2 electrode 3 side, 11 an opening of the G3 electrode 4 on the G4 electrode 5 side, 12 an aperture of the G4 electrode 5, 13 an opening of the G5 electrode 6 on the G4 electrode 5 side, 14 an opening of the G5 electrode 6 on the G6 electrode 7 side, and 15 an opening of the G6 electrode 7.

Figure 5:
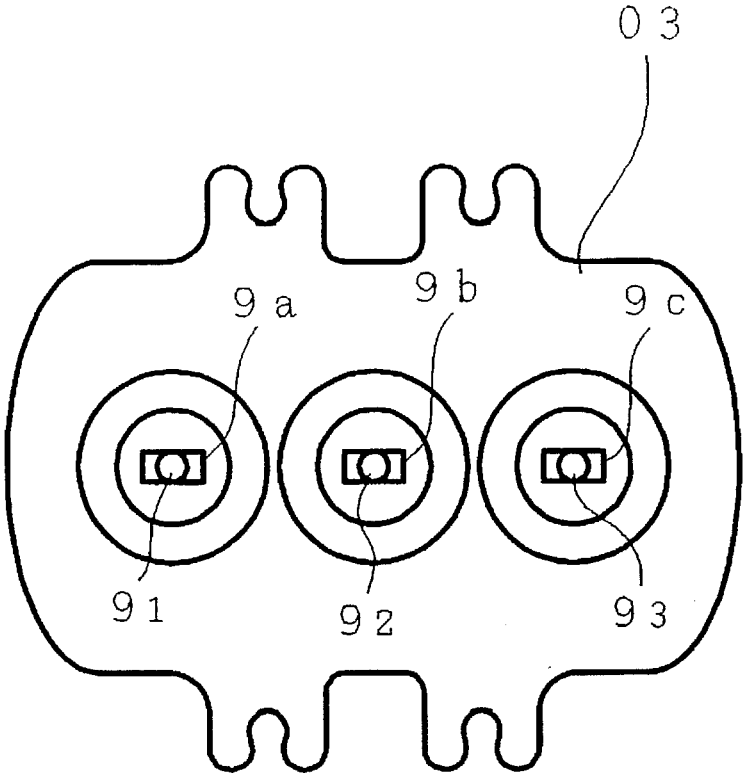
FIG. 5 depicts a plan view illustrating the G2 electrode having the horizontally elongated rectangular recesses superposed on the aperture of the G2 electrode, on the G3 electrode side.

A diameter of the aperture 8 of the G1 electrode 2 is 0.45 mm. A diameter of the aperture 9 of the G2 electrode 3 is 0.52 mm. The aperture of the G2 electrode 3 on the G3 electrode 4 side has a horizontally elongated rectangular recess superposed thereon as illustrated in FIG. 5.

Diameters of the opening 11 of the G3 electrode 4 on the G4 electrode 5 side, the opening 12 of the G4 electrode 5 which corresponds to the lens diameter of the sub-main lens, and the opening 13 of the G5 electrode 6 on the G4 electrode 5 side are 3.9 mm. An axial length of the G4 electrode 5 is 1.0 mm. An axial length of the G5 electrode 6 is 16.0 mm.

With the dimensions mentioned above, the ratio A of the axial length of the G4 electrode 5 to the diameter of the opening of the G4 electrode (the lens diameter of the sub-main lens) is 0.26. The ratio B of the axial length of the G5 electrode 6 to the diameter of the opening of the G4 electrode (the lens diameter of the sub-main lens) is 4.10. The ratio A and the ratio B lie within the hatched area indicated in FIG. 2.

In this embodiment, the vertical diameter of the beam spot at the center of the screen was 0.75 mm. The average diameter of the beam spot at the center of the screen was 0.68 mm. A ratio in the spot diameter of the periphery to the center of the screen was 1.20.

It is more preferable that the ratios A and B are 0.26±10% and 4.1±10%, respectively, as well as lie within the hatched area indicated in FIG. 2.

The color cathode-ray tube having the electron gun of this embodiment does not suffer deterioration in electric breakdown strength, difficulties in parts production, or occurrence of objectionable vertical moire in the displayed image.

As described above, the present invention has the relationship between the ratio A of the axial length of the G4 electrode to the diameter of the opening of the G4 electrode (the lens diameter of the sub-main lens) and the ratio B of the axial length of the G5 electrode to the diameter of the opening of the G4 electrode (the lens diameter of the sub-main lens) defined. The present invention provides the color cathode-ray tube having the in-line type electron gun that increases electric breakdown strength, facilitates parts production, and displays quality image with vertical moire suppressed over the entire screen without deteriorating focus characteristic.

What is claimed is:

1. A color cathode-ray tube having an in-line type electron gun comprising electron beam generating means comprising a cathode, a first electrode, and a second electrode for emitting three electron beams toward a phosphor screen, a sub-main lens formed of a third electrode, a fourth electrode and a fifth electrode, and a main lens formed of said fifth electrode and a sixth electrode for focusing said three electron beams onto said phosphor screen in cooperation with said sub-main lens, said cathode and said first to sixth electrodes being arranged in this order, and said second and fourth electrodes being electrically connected together and said third and fifth electrodes being electrically connected together, wherein a ratio A of an axial length of said fourth electrode to a diameter of an opening of said fourth electrode and a ratio B of an axial length of said fifth electrode to said diameter of said opening of said fourth electrode satisfy the following equations:

$$54A-5B+4\leqq 0,$$

$$55A-5B+7\geqq 0,$$

$$A-0.18\geqq 0,$$

and $$95A+10B-73\leqq 0.$$

2. The color cathode-ray tube according to claim 1, wherein a voltage applied on said second and fourth electrodes is lower than 1,000 V, a voltage applied on said third and fifth electrodes is in the range of 20 to 33% of a voltage applied to said sixth electrode.

3. The color cathode-ray tube according to claim 1, wherein a horizontally elongated rectangular recess enclosing a beam passage aperture is provided on a third electrode side of said second electrode.

4. The color cathode-ray tube according to claim 1, wherein said diameter of said opening of said fourth electrode is in a range of 3 mm to 6.2 mm.

5. The color cathode-ray tube according to claim 1, wherein the ratio A is in a range of 0.23 to 0.29 and the ratio B is in a range of 3.6 to 4.5.

6. The color cathode-ray tube according to claim 1, wherein the ratio A and the ratio B have values satisfying the equations so as to enable a reduction in deterioration in focus characteristics and substantial elimination of moire over said screen.

* * * * *